United States Patent [19]

Kosal

[11] Patent Number: 4,741,862

[45] Date of Patent: May 3, 1988

[54] ZEOLITE BUILT DETERGENT COMPOSITIONS

[75] Inventor: Jeffrey A. Kosal, Midland, Mich.

[73] Assignee: Dow Corning Corporation, Midland, Mich.

[21] Appl. No.: 899,128

[22] Filed: Aug. 22, 1986

[51] Int. Cl.[4] ..... C11D 3/12; C11D 3/33

[52] U.S. Cl. ..... 252/527; 252/174.15; 252/174.19; 252/174.16; 252/174.25; 252/DIG. 11

[58] Field of Search ..... 252/140, 155, 174.25, 252/174.15, 174.24, 174.19, 527, DIG. 11

[56] References Cited

U.S. PATENT DOCUMENTS

| | | | |
|---|---|---|---|
| 4,138,363 | 2/1979 | Hertzenberg et al. | 252/430 |
| 4,157,978 | 6/1979 | Llenado | 252/135 |
| 4,216,125 | 8/1980 | Campbell et al. | 252/527 |
| 4,243,451 | 1/1981 | Campbell et al. | 252/140 |
| 4,267,068 | 5/1981 | Diessel et al. | 252/179 |
| 4,303,556 | 12/1981 | Llendado | 252/527 |
| 4,478,735 | 10/1984 | Yazaki et al. | 252/135 |
| 4,534,880 | 8/1985 | Kosal et al. | 252/174.13 |
| 4,549,979 | 10/1985 | Chandra et al. | 252/135 |
| 4,605,509 | 8/1986 | Corkill et al. | 252/131 |

FOREIGN PATENT DOCUMENTS

| | | |
|---|---|---|
| 2539110 | 4/1976 | Fed. Rep. of Germany . |
| 3248022 | 6/1984 | Fed. Rep. of Germany . |
| 2013100 | 8/1979 | United Kingdom . |

*Primary Examiner*—Prince E. Willis

*Attorney, Agent, or Firm*—Robert L. McKellar

[57] ABSTRACT

Particulate detergent compositions suitable for heavy duty laundry applications are disclosed. The detergents contain organic surfactant, zeolite, alkali silicate, anionic functional organosiliconate, and complexing agent for trivalent aluminum. The combined action of the siliconate and the complexing agent provide long lasting improvments in the dissolution characteristics of the detergent particles in wash water.

18 Claims, No Drawings

ZEOLITE BUILT DETERGENT COMPOSITIONS

BACKGROUND OF THE INVENTION

This invention relates to detergent formulations built with zeolites and also containing alkali silicates. More particularly, it relates to particulate detergent compositions wherein the zeolite agglomerates are more readily dispersible in the wash water. Specifically, the dispersibility of the zeolite agglomerates is improved by including an anionic functional organosiliconate and a complexing agent for trivalent aluminum in the detergent composition.

Alkali silicates have been widely used in laundry detergents for many years. In addition to providing alkalinity and buffering, alkali silicates are important as corrosion inhibitors and process aids that improve the bead strength of detergent powders. Recent developments such as the reduction in the amount of phosphates in detergents; increased use of surfactants with unique properties; and the higher cost of energy, which affects household washing temperatures as well as the cost of manufacturing detergents by spray drying have compelled many changes in detergent formulations.

However, because of the nature of detergents as complex mixtures of ingredients, changing one component or process method can generate several new problems. In particular, the use of zeolites in detergents to replace all or part of the phosphates in formulations also containing alkali silicates has produced agglomerates that deposit on the fabric being laundered and are especially noticeable as white particulate material on dark fabrics. It has been suggested that the zeolite agglomeration results from the interaction of the zeolite with other detergent ingredients during the spray drying process.

Alkali silicates have been implicated as a component of detergents that may interact with zeolites to bind particles together and form nondispersible agglomerates. Consequently, it has been proposed that only limited amounts of silicate, 3% or less, should be used in zeolite built laundry detergents. Moreover, larger amounts of alkali silicates have been reported to decrease the ion exchange capacity and the rate of ion exchange of the zeolites in a formulated detergent. However, reducing the amount or eliminating alkali silicates in detergent formulations is not a satisfactory solution because it results in the loss or reduction of the valuable properties such as bead formation and anticorrosion that the silicate provides.

Considerable effort has been expended in attempts to develop commercially viable ways of making alkali silicates and zeolites compatible in detergent formulations. For example, U.S. Pat. No. 4,157,978 teaches that multimeric silicates can be "capped" by aluminum diacetate groups and incorporated in spray dried detergent compositions to provide an overall improvement in the physical characteristics and rate of solubility of the resulting detergent granules. The patent also suggests that other "capped" silicate materials known in the art can be used in detergent formulations. As an example of such other "capped" silicates, the patent describes silicates "capped" by triorganosilyl groups.

U.S. Pat. Nos. 4,138,363, 4,216,125, 4,243,545, and 4,534,880 teach that the tendency of zeolites to agglomerate during detergent processing can be reduced by treating the zeolite surface with a hydrophilic functional silane or an anionic functional organosiliconate. Taking a somewhat different approach, U.S. Pat. No. 4,549,979 teaches that by combining an anionic functional organosiliconate with the silicate in detergent compositions containing zeolite, the solubility characteristics of the silicate are modified so that the zeolite agglomerates more readily breakup and disperse in the wash water. Particulate detergents containing the anionic functional organosiliconate according to U.S. Pat. No. 4,549,979 dispersed well in water when first made, but after periods of shelf aging, the dissolution characteristics of the zeolite agglomerates deteriorated dramatically.

SUMMARY OF THE INVENTION

It is an object of the present invention to provide particulate detergent compositions in which the agglomerated particles of zeolite and other components exhibit improved dissolution properties in wash water. It is a further object of the invention to provide particulate detergent compositions which retain good dissolution characteristics upon aging.

The present invention provides particulate detergent compositions comprising (A) 5 to 50 parts by weight of an organic surfactant selected from the group consisting of anionic, nonionic and ampholytic surfactants; (B) 5 to 50 parts by weight of zeolite; (C) 1 to 25 parts by weight of a silicate represented generally by the formula $(MO)_nSiO_{(4-n)/2}$ wherein M is hydrogen or alkali metal and n has an average value from 0.5 to 3; (D) 0.1 to 5 parts by weight of siliconate represented generally by the formula $(MO)_aO_{(3-a)/2}Si\text{-}R\text{-}Y_b$ wherein Y represents an anionic functional group, R is an organic linking group wherein Y is positioned at least 2 carbon atoms removed from the silicon atom, b is an integer from 1 to 3, a has a value of from 0.5 to 3, and M is hydrogen or alkali metal; and (E) 0.1 to 5 parts by weight of a complexing agent for trivalent aluminum selected from the group consisting of water soluble alkali halide salts, polycarboxylic acid chelating agents, alpha-hydroxy carboxylic acid chelating agents, and polyhydroxy chelating agents.

In a preferred embodiment, the invention relates to a particulate detergent composition comprising organic surfactant, zeolite, silicate, siliconate, and an alkali halide salt.

DETAILED DESCRIPTION OF THE INVENTION

The present invention is based on the discovery that certain additives can be used to improve shelf stability in detergent formulations such as described in U.S. Pat. No. 4,549,979. Specifically, it was found that when a complexing agent for trivalent aluminum is added into the slurry of detergent ingredients prior to spray drying, the detergent granules maintained good dissolution properties for longer periods. This is a surprising result since the complexing agents without the siliconate ingredient taught by the above patent do not typically have any beneficial effect on dissolution properties of zeolite containing detergent granules.

The process by which the complexing agents act to stabilize the detergent particles is not fully understood. Applicant believes that aluminate species which are released from the zeolite may be present on or migrate to the surface of the silicate binder and thus lower the solubility of the silicate and thereby prevent the breakup and dissolution of the detergent particle. It is believed that the process whereby the aluminate species gradually reduce the solubility of silicate may be accelerated by exposure to ambient air especially the carbon dioxide component of air. Solubility changes with aging are reduced by minimizing the extent of aluminate species present by tying up any trivalent aluminum with complexing agent.

It should be understood that applicant does not intend to limit the invention by presenting this theory concerning the nature of silicate-aluminate interaction. Indeed, applicant recognizes that other mechanisms may contribute to the benefits of the invention or may even completely account for the benefits.

The detergent compositions of this invention contain an organic detersive surfactant selected from the group consisting essentially of anionic, nonionic, and ampholytic surfactants. Any of the known water soluble detersive surfactants are anticipated to be useful in the detergent compositions of this invention. Water soluble detersive surfactants include the anionics such as common soap, alkylbenzene sulfonates and sulfates, paraffin sulfonates, and olefin sulfonates; the nonionics such as alkoxylated (especially ethoxylated) alcohols and alkyl phenols, amine oxides; and the ampholytics such as the aliphatic derivatives of heterocyclic secondary and tertiary amines.

In general, the detersive surfactants contain an alkyl group in the $C_{10}$–$C_{18}$ range; the anionics are most commonly used in the form of their sodium, potassium, or triethanolammonium salts; and the nonionics generally contain from about 3 to about 17 ethylene oxide groups. U.S. Pat. No. 4,062,647, which is hereby incorporated by reference, contains detailed listings of the anionic, nonionic and ampholytic detersive surfactants useful in this invention. Mixtures, especially mixtures of $C_{12}$–$C_{16}$ alkyl benzene sulfonates with $C_{12}$–$C_{18}$ alcohol or alkylphenol ethoxylates (EO 3-15) provide detergent compositions with exceptionally good fabric cleaning properties.

The detergent compositions of this invention contain from 5 to 50 parts by weight of zeolite for each 5 to 50 parts by weight of detersive surfactant. In other words the ratio of zeolite to surfactant may vary from 1:10 to 10:1.

Any of the synthetic or natural zeolites can be employed in the detergent compositions. In general, synthetic zeolites are usually employed because they are more readily available and are specially manufactured to have more desirable and consistent properties. Synthetic crystalline sodium alumina silicates such as those described in U.S. Pat. Nos. 2,882,243, 3,012,853, 3,130,007, 3,329,628 and 4,303,629, among others, are suitable. While any zeolite can be used in detergents, it is usually preferred to employ zeolites conforming to the general formula:

$$Na_x[(AlO_2)_x(SiO_2)_y[zH_2O$$

where x and y are integers of at least 6; the ratio of x to y is in the range of 0.1 to 1.1; and z is an integer from about 8 to 270. In general, the water content of these zeolites is 15 to 35 percent by weight of the zeolite. Specific examples of useful zeolites include among others, zeolites generally conforming to the formula, $Na_{12}[(AlO_2)_{12}(SiO_2)_{12}]20H_2O$ and zeolites generally conforming to the formula $Na_x[(AlO_2)_x(SiO_2)_y]zH_2O$ where x is an integer between 80 and 96 and y is an integer between 96 and 112 and z is between 220 and 270. Zeolites are well known in the art and have been described in many patents in recent years for use as builders in laundry detergent formulations.

The detergent compositions of this invention contain from 1 to 25 parts by weight of water soluble alkali metal silicate for each 5 to 50 parts by weight of detersive surfactant. In other words the ratio of silicate to surfactant may vary from 1:50 to 5:1. Preferably, the ratio of silicate to surfactant is within the range of 1:20 to 1:1.

Any of the water soluble alkali metal silicates can be used in the detergent compositions. Water soluble alkali metal silicates are represented generally by the formula $(MO)_nSiO_{(4-n)/2}$ wherein M is hydrogen or alkali metal and n has an average value from 0.5 to 3. Soluble alkali metal silicates are also typically characterized by having a molar ratio of $SiO_2$ to alkali metal oxide from 1:1 to 4:1. Soluble silicates are available commercially as free flowing powders or as aqueous solutions ranging up to about 50 percent solids. The sodium silicates are usually preferred in detergent compositions of this invention, although potassium and lithium silicates can also be used.

The detergent compositions of this invention contain from 0.1 to 5 parts by weight of anionic functional organosiliconate for each 5 to 50 parts by weight of detersive surfactant. In other words the ratio of siliconate to surfactant may vary from 1:500 to 1:1. Preferably, the ratio of siliconate to surfactant varies from 1:100 to 1:5.

Anionic functional organosiliconates are known materials and are described further in U.S. Pat. Nos. 3,198,820, 3,816,184, 4,235,638, 4,344,860, 4,352,742, 4,354,002, 4,362,644, 4,370,255, and 4,549,979 which are hereby incorporated by reference to further illustrate the anionic functional organosiliconates and to show methods for their preparation. The siliconates are organosilicon compounds in which the organic substituent is attached to silicon by a silicon-carbon bond. The organic substituent also carries an anionic functional group which is attached to the substituent at least 2 and preferably 3 or more carbon atoms removed from the bond to silicon. An anionic functional group is a group that exists predominately in a disassociated ionic state in aqueous solutions and thus provides the organic substituent attached to silicon with a negative charge.

Anionic functional groups can be described generally as salts of oxyacids. Anionic functional groups include salts of sulfonic acids, salts of phosphonic acid, salts of monoesters of phosphonic acids, and salts of carboxylic acids. Generally the alkali metal salts of the acids are preferred although salts derived from other bases such as organic quaternary ammonium hydroxide compounds can also be employed.

It should be understood that the organic substituent of the siliconate may also contain other functionality such as ether, sulfide, hydroxy, amide, and amine. The general form of the anionic siliconates is represented by the formula:

$$(MO)_aO_{(3-a)/2}Si\text{-}R\text{-}Y_b$$

wherein R is an organic linking group wherein the anionic functionality or any other functionality is positioned at least 2 and preferably at least 3 carbon atoms removed from the silicon atom, Y represents anionic functional groups, and b represents the number of anionic functional groups on the linking group and can vary from 1 to 3. In the formula, M represents the cation of a strong base such as alkali metal cations or organo quaternary ammonium cations or M represents a hydrogen such that the siliconate also contains silanol functionality. Generally, a can vary from about 0.5 to 3.

The organic linking group, R, may contain other atoms in addition to carbon and hydrogen such as, for example, oxygen, sulfur, and nitrogen. These atoms may be present as other functional groups such as, for example, ether, sulfide, hydroxy, amide or amine. Other functionality as represented by these exemplary atoms should be positioned at least 2 and preferably 3 or more carbon atoms removed from the site of silicon atom attachment in the linking group. Such positioning of functionality within the linking group provides substituents on silicon that are more stable and less readily cleaved. Generally it is preferred that the linking group contain from 2 to a maximum of about 16 carbon atoms. While linking groups with greater than 16 carbon atoms may be used in the invention, it is believed that the hydrophobic character produced by such linking groups reduces the effectiveness of the siliconates so that linking groups with greater than 16 carbon atoms are less preferred.

Linking groups represented by R include, among others, polyvalent hydrocarbon radicals such as dimethylene, trimethylene, hexadecamethylene, phenylene, tolylene, xenylene, napthylene and substituted polyvalent hydrocarbon radicals such as $-(CH_2)_3OCH_2CH(OH)CH_2-$, $-(CH_2)_3SCH_2-$,

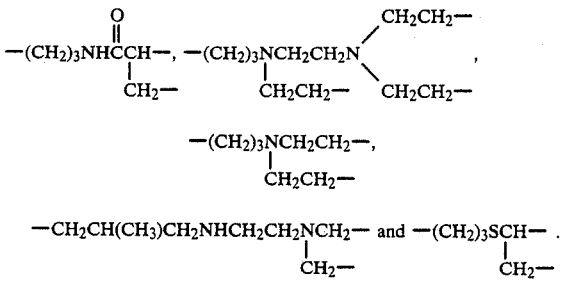

When M is an alkali metal cation it is preferred that it be sodium because of its ready availability and low cost. Similarly, the sodium salts of the oxyacids are preferred anionic functional groups in the siliconates.

For example, anionic siliconates suitable for the present invention include composiions conforming generally to the formulas:

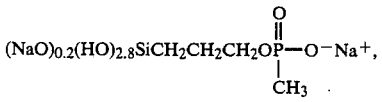

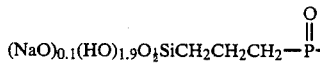

$(NaO)_2(HO)Si(CH_2)_6SO_3^-Na^+$,

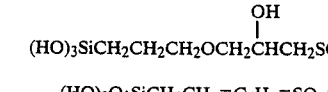

$(HO)_2O_{\frac{1}{2}}SiCH_2CH_2-C_6H_5-SO_3^-K^+$,
$(KO)_{0.2}(HO)_{1.8}O_{\frac{1}{2}}SiCH_2CH_2SCH_2COO^-K^+$,

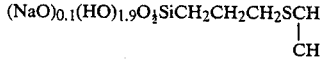

-continued

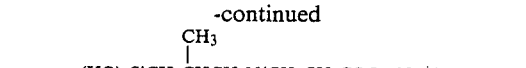

$(HO)_3SiCH_2CH_2CH_2NHCH_2CH_2N(CH_2COO^-Na^+)_2$,

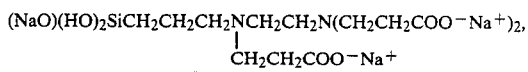

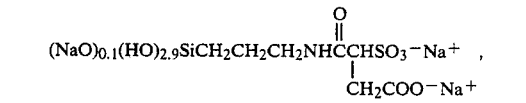

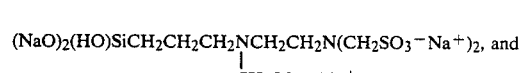

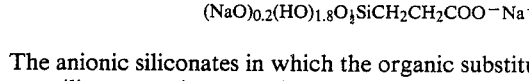

$(NaO)_{0.2}(HO)_{1.8}O_{\frac{1}{2}}SiCH_2CH_2COO^-Na^+$.

The anionic siliconates in which the organic substituent on silicon contains more than one anionic functional group are preferred because of their more highly anionic character and because of their improved effectiveness in modifying the dissolution characteristics of silicate solids. Specifically, anionic functional siliconates represented by the formula $(MO)_aO_{(3-a)/2}Si-R-Y_b$ wherein b has the value 2 or 3 are preferred. On especially preferred siliconate is represented generally by the formula

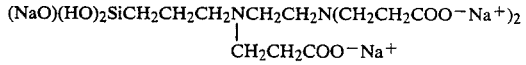

The anionic siliconates are water soluble materials and are usually prepared and stored in aqueous solutions.

The detergent compositions of this invention contain from 0.1 to 5 parts by weight of a complexing agent for trivalent aluminum for each 5 to 50 parts by weight of detersive surfactant. In other words the ratio of complexing agent to surfactant may vary from 1:500 to 1:1. Preferably, the ratio of alkali halide to surfactant varies from 1:100 to 1:2.

Any complexing agent which will bind trivalent aluminum ions in aqueous solutions and thereby reduce the level of aluminate ions present can be used in the detergent compositions of this invention. For example, suitable complexing agents include alkali halides such as sodium fluoride, potassium fluoride, lithium fluoride, sodium chloride, potassium chloride, and sodium bromide; polycarboxylic acid chelating agents such as alkali metal salts of ethylenediaminetetraacetic acid, alkali metal salts of nitrilotriacetic acid, alkali metal salts of diethylenetriaminepentaacetic acid, and alkali metal salts of 1,2-cyclohexylenedinitrilotetraacetic acid; alphahydroxy carboxylic acid chelating agents such as alkali metal salts of gluconic acid, citric acid, tartaric acid, and glucoheptonic acid; and polyhydroxy chelating agents such as 2-ethyl-1,3-hexanediol.

While complexing agents for aluminum generally provide improved stability in regard to dissolution of detergent particles according to the present invention, it has been found that the most durable improvements in dissolution properties are provided by incorporation of a water soluble alkali halide salt in the detergent composition. In other words, halide ions provided by such salts are the preferred complexing agents for use in the detergent compositions of the present invention. Correspondingly, in the preferred embodiment of this invention the detergent composition contains from 0.1 to 5 parts by weight of an alkali halide salt for each 5 to 50 parts by weight of detersive surfactant. In other words the ratio of alkali halide to surfactant may vary from 1:500 to 1:1. Preferably, the ratio of alkali halide to surfactant varies from 1:100 to 1:2.

Among the halide salts the greatest improvement has been observed with the fluorides so that it is even more preferred that the detergents of this invention contain an alkali fluoride, preferably sodium fluoride. Fluorides are also preferred because, they are effective at lower concentrations and consequently they present less of a problem in regard to corrosion of processing equipment than chlorides.

Water soluble builders such as the alkali carbonates and the alkali phosphates and polyphosphates, specifically sodium tripolyphosphate, can be used in addition to the zeolite as auxiliary builders in the detergent compositions of this invention. Generally when they are needed, 5 to 50 parts by weight of auxiliary builders are used for each 5 to 50 parts by weight of detersive surfactant. Especially preferred detergent compositions contain a mixture of auxiliary builder, preferably sodium tripolyphosphate, and zeolite in a weight ratio ranging from 1:2 to 2:1.

Other minor detergent ingredients as known in the art may be included for various purposes. For example, antiredeposition agents such as sodium carboxymethylcellulose, suds suppressors, enzymes, optical brighteners, perfumes, anticaking agents, dyes, colored specks, and fabric softeners can also be included in the detergent compositions.

Finally, bulking agents such as sodium sulfate can be added to the detergent formulation to facilitate measurement of appropriate amounts for individual wash loads.

The detergent compositions of this invention can be used as heavy duty laundry detergents. These detergents have increased utility because they dissolve more easily in water, especially at the lower washing temperatures that are increasingly used by today's energy-conscious consumers.

Any of the well known commercial methods of preparing detergent compositions can be employed to make the detergent compositions of this invention. For example, the surfactant, zeolite, silicate, siliconate, and complexing agent along with any auxiliary builder or other components can be combined in an aqueous slurry and then spray dried to provide granules. It is not necessary to premix any specific components or mix the components in any specific order when preparing the slurry for spray drying. Of course, spray drying sensitive ingredients such as enzymes, bleach components, and suds regulating components can be dry mixed with detergent powders after the spray drying process.

The following examples are presented to illustrate the invention to those skilled in the art and should not be construed as limiting the invention, which is properly delineated in the appended claims. All proportions by parts or percents are by weight unless otherwise stated.

EXAMPLE 1

This example illustrates the improved dissolution characteristics of the particulate detergent compositions of the present invention especially in regard to the permanence of the improved dissolution characteristics upon exposure to ambient air.

Particulate detergent compositions were prepared by drying aqueous slurries of the individual ingredients using a laboratory scale rotary spray dryer. The conditions for drying were selected to provide about 6 to 8 percent residual water in the final particulate product. The following ingredients were used in the compositions:

LAS—sodium salt of linear dodecylbenzenesulfonate,
$Na_2CO_4$ —sodium carbonate,
SS—sodium silicate (2.4 weight ratio $SiO_2/Na_2O$),
$Na_2SO_4$ —sodium sulfate,
Siliconate—anionic functional organosiliconate represented by the average formula $$(NaO)_{0.3}(KO)_{1.7}\underset{\underset{OH}{|}}{Si}(CH_2)_3\underset{\underset{CH_2CH_2COO^-Na^+}{|}}{N}CH_2CH_2N(CH_2CH_2COO^-Na^+)_2,$$

Zeolite—detergent grade zeolite A, and
NaF—sodium fluoride.

The percent by weight of the ingredients in the detergent compositions are shown in Table 1.

TABLE 1

DETERGENT FORMULATIONS

| Ingredient | Compositions (% by weight) A | B | C | D |
|---|---|---|---|---|
| LAS | 19 | 19 | 19 | 19 |
| $Na_2CO_4$ | 22 4 | 22 | 22 | 22 |
| $Na_2SO_4$ | 13 | 12.5 | 12.3 | 12.7 |
| Zeolite | 32 | 31.5 | 31 | 32 |
| SS | 6.4 | 6.2 | 6.2 | 6.3 |
| Siliconate | — | 1.7 | 1.3 | — |
| NaF | — | — | 1 | 1 |
| Water | 7 | 7.2 | 7.2 | 7.1 |

The detergent compositions were evaluated by a black cloth test to determine the amount of insoluble particles that might be retained on fabric while laundering. For the test, 0.75 g of the particulate detergent composition was agitated for 10 minutes in 1000 ml of deionized water with an impeller blade stirrer operating at 350 rpm. After agitation, the mixture was vacuum filtered through a 13 mm diameter piece of black broadcloth. After the cloth had air dried, the extent of white particles was evaluated by measuring the reflectivity of the cloth. The detergent compositions were evaluated initially after spray drying and also after exposure in an open dish to ambient air for periods of one or more days. Open dish exposure to ambient air is an accelerated test for shelf stability of detergent compositions. Poor dissolution is indicated by high reflectivity values caused by retention of greater amounts of white particles on the black cloth. The results are shown in Table 2.

TABLE 2

BLACK CLOTH TEST FOR INSOLUBLE PARTICLES

| Detergent Composition | Reflectivity Initial | 1 day | 4 days | 7 days | 11 days |
|---|---|---|---|---|---|
| A | 47.8 | — | — | — | — |
| B | 7.5 | 34.2 | 56 | — | — |
| C | 3.3 | — | 3.2 | 6.3 | 4.1 |
| D | 41.9 | 42.6 | | 60 | 52 |

Detergent compositions A, B, and D are presented for comparison, while composition C is representative of the present invention. Composition C (containing both siliconate and aluminum complexing agent) retains its excellent dissolution characteristics throughout the exposure period. The other compositions exhibited poor dissolution initially or after relatively short periods of ambient air exposure as in the case with composition B (containing siliconate without an aluminum complexing agent). Composition D further illustrates that an aluminum complexing agent offers little if any benefit without the corresponding use of the siliconate.

EXAMPLE 2

This example shows detergent compositions containing several different alkali halides and illustrates the improved stability of the dissolution characteristics provided by the alkali halides.

Particulate detergents were prepared as described in Example 1 having the compositions shown in Table 3. The detergent compositions were evaluated by the black cloth test described in Example 1. The results are shown in Table 4.

TABLE 3

DETERGENT FORMULATIONS

| Ingredient | Compositions (% by weight) E | F | G | H | I |
|---|---|---|---|---|---|
| LAS | 18.8 | 18.8 | 18.8 | 18.8 | 18.8 |
| $Na_2CO_4$ | 21.1 | 21.5 | 21.2 | 22.1 | 22.1 |
| $Na_2SO_4$ | 12.5 | 12.5 | 12.5 | 12.5 | 12.5 |
| Zeolite | 31.2 | 31.2 | 31.2 | 31.2 | 31.2 |
| SS | 6.2 | 6.2 | 6.2 | 6.2 | 6.2 |
| Siliconate | 1.3 | 1.3 | 1.3 | 1.3 | 1.3 |
| NaCl | 1.7 | — | — | — | — |
| NaF | — | 1.2 | — | — | — |
| $KF.2H_2O$ | — | — | 1.7 | — | — |
| $Na_2SiF_6$ | — | — | — | 0.9 | — |
| $(NH_4)_2SiF_6$ | — | — | — | — | 0.9 |
| Water | 7.2 | 7.3 | 7.1 | 7.0 | 7.0 |

TABLE 4

BLACK CLOTH TEST FOR INSOLUBLE PARTICLES

| Detergent Composition | Reflectivity Initial | 1 day | 2 days | 6 days | 8 days |
|---|---|---|---|---|---|
| E | 4.8 | 7.1 | 5.3 | 12.1 | 29.1 |
| F | 2.8 | 4.2 | 3.1 | 5.2 | 8.7 |
| G | 3.9 | 6.2 | 7.2 | 15.1 | 22.5 |
| H | 59.2 | — | — | — | — |
| I | 62.4 | — | — | — | — |

Detergent compositions E, F, and G (containing NaCl, NaF, and KF respectively) showed improved retention of dissolution properties during the ambient air exposure tests. In comparison, detergent compositions H and I exhibited poor dissolution even before exposure to ambient air.

EXAMPLE 3

This example shows detergent compositions containing several different organic chelating agents and illustrates the improved stability of the dissolution characteristics provided by the organic chelating agents.

Particulate detergents were prepared as described in Example 1 having the compositions shown in Table 5. Ethylenediaminetetraacetic acid tetrasodium salt ($Na_4EDTA$), 1,2-cyclohexylenedinitrilotetraacetic acid (CDTA), and 2-ethyl-1,3-hexanediol (EHD) were used in the detergent formulations. The detergent compositions were evaluated by the black cloth test described in Example 1. The results are shown in Table 6.

TABLE 5

DETERGENT FORMULATIONS

| Ingredient | Compositions (% by weight) J | K | L | M |
|---|---|---|---|---|
| LAS | 19 | 19 | 19 | 19 |
| $Na_2CO_4$ | 18.1 | 18.8 | 20.6 | 19.6 |
| $Na_2SO_4$ | 12.5 | 12.5 | 12.5 | 12.5 |
| Zeolite | 31 | 31 | 31 | 31 |
| SS | 6.2 | 6.2 | 6.2 | 6.2 |
| Siliconate | 1.3 | 1.3 | 1.3 | — |
| $Na_4EDTA$ | 3.9 | | | 3.9 |
| CDTA | — | 3.4 | — | — |
| EHD | — | — | 1.4 | — |
| Water | 8 | 7.8 | 8 | 7.8 |

TABLE 6

BLACK CLOTH TEST FOR INSOLUBLE PARTICLES

| Detergent Composition | Reflectivity Initial | 1 day | 4 days |
|---|---|---|---|
| J | 2.2 | 55.2 | 52.6 |
| K | 4.2 | 6.3 | 16.9 |
| L | 2.4 | 6.8 | 22.8 |
| M | 50.5 | 56.1 | — |

Detergent compositions J, K, and L showed good initial dissolution with compositions K and L also showing improved retention of dissolution properties during the ambient air exposure tests. Composition M also shows again that without siliconate, initial dissolution properties are poor.

That which is claimed is:

1. A particulate detergent composition comprising (A) 5 to 50 parts by weight of an organic surfactant selected from the group consisting of anionic, nonionic and ampholytic surfactants;

(B) 5 to 50 parts by weight of zeolite;

(C) 1 to 25 parts by weight of a silicate represented generally by the formula $$(MO)_n Sio_{(4-n)/2}$$

wherein M is hydrogen or alkali metal and n has an average value from 0.5 to 3;

(D) 0.1 to 5 parts by weight of siliconate represented generally by the formula $$(MO)_a O_{(3-a)/2} Si—R—Y_b$$

wherein Y represents an anionic functional group, R is an organic linking group wherein Y is positioned at least 2 carbon atoms removed from the silicon atom, b is an integer from 1 to 3, a has a value of from 0.5 to 3, and M is hydrogen or alkali metal; and (E) 0.1 to 5 parts by weight of a complexing agent for trivalent aluminum selected from the group consisting of water soluble alkali metal halide salts, polycarboxylic acid chelating agents, alpha-hydroxy carboxylic acid chelating agents, and polyhydroxy chelating agents.

2. The detergent composition of claim 1 which further comprises 5 to 50 parts by weight of an auxiliary builder selected from the group consisting of alkali tripolyphosphates, alkali phosphates, and alkali carbonates.

3. The detergent composition of claim 1 wherein the anionic functional group is an alkali metal salt of an oxyacid selected from the group consisting of alkali metal salts of sulfonic acids, phosphonic acids, monoesters of phosphonic acids and carboxylic acids.

4. The detergent composition of claim 3 wherein the anionic functional siliconate is represented by the formula $$(MO)_aO_{(3-a)/2}SiCH_2CH_2CH_2O\overset{\overset{O}{\|}}{\underset{\underset{CH_3}{|}}{P}}-O^-Na^+$$

wherein M is hydrogen or sodium.

5. The detergent composition of claim 3 wherein b is 2 or 3 and the organic linking group, R, contains 2 to 16 carbon atoms and is selected from the group consisting of radicals composed of carbon and hydrogen; radicals composed of carbon, hydrogen, and oxygen; radicals composed of carbon, hydrogen, and sulfur; and radicals composed of carbon, hydrogen, and nitrogen.

6. The detergent composition of claim 5 wherein Y is an alkali metal salt of a carboxylic acid group and R is a radical composed of carbon, hydrogen and nitrogen atoms.

7. The detergent composition of claim 6 wherein the anionic functional siliconate is represented by the formula $$(MO)_aO_{(3-a)/2}SiCH_2CH_2CH_2\underset{\underset{CH_2CH_2COO^-Na^+}{|}}{N}CH_2CH_2N(CH_2CH_2COO^-Na^+)_2$$

wherein M is independently selected from the group consisting of hydrogen, sodium, and potassium.

8. The detergent composition of claim 7 wherein the complexing agent is 1,2-cyclohexylenedinitrilotetraacetic acid or a sodium salt of 1,2-cyclohexylenedinitrilotetraacetic acid.

9. The detergent composition of claim 7 wherein the complexing agent is 2-ethyl-1,3-hexanediol.

10. A particulate detergent composition comprising (A) 5 to 50 parts by weight of an organic surfactant selected from the group consisting of anionic, nonionic and ampholytic surfactants;

(B) 5 to 50 parts by weight of zeolite;

(C) 1 to 25 parts by weight of a silicate represented generally by the formula $$(MO)_nSiO_{(4-n)/2}$$

wherein M is hydrogen or alkali metal and n has an average value from 0.5 to 3;

(D) 0.1 to 5 parts by weight of siliconate represented generally by the formula $$(MO)_aO_{(3-a)/2}Si-R-Y_b$$

wherein Y represents an anionic functional group, R is an organic linking group wherein Y is positioned at least 2 carbon atoms removed from the silicon atom, b is an integer from 1 to 3, a has a value of from 0.5 to 3, and M is hydrogen or alkali metal; and (E) 0.1 to 5 parts by weight of a water soluble alkali halide salt.

11. The detergent composition of claim 10 wherein the alkali halide salt is an alkali fluoride.

12. The detergent composition of claim 11 wherein the alkali fluoride is sodium fluoride.

13. The detergent composition of claim 12 which further comprises 5 to 50 parts by weight of an auxiliary builder selected from the group consisting of alkali tripolyphosphates, alkali phosphates, and alkali carbonates.

14. The detergent composition of claim 12 wherein the anionic functional group is an alkali metal salt of an oxyacid selected from the group consisting of alkali metal salts of sulfonic acids, phosphonic acids, monoesters of phosphonic acids and carboxylic acids.

15. The detergent composition of claim 14 wherein the anionic functional siliconate is represented by the formula $$(MO)_aO_{(3-a)/2}SiCH_2CH_2CH_2O\overset{\overset{O}{\|}}{\underset{\underset{CH_3}{|}}{P}}-O^-Na^+$$

wherein M is hydrogen or sodium.

16. The detergent composition of claim 14 wherein b is 2 or 3 and the organic linking group, R, contains 2 to 16 carbon atoms and is selected from the group consisting of radicals composed of carbon and hydrogen; radicals composed of carbon, hydrogen, and oxygen; radicals composed of carbon, hydrogen, and sulfur; and radicals composed of carbon, hydrogen, and nitrogen.

17. The detergent composition of claim 16 wherein Y is an alkali metal salt of a carboxylic acid group and R is a radical composed of carbon, hydrogen and nitrogen atoms.

18. The detergent composition of claim 17 wherein the anionic functional siliconate is represented by the formula $$(MO)_aO_{(3-a)/2}SiCH_2CH_2CH_2\underset{\underset{CH_2CH_2COO^-Na^+}{|}}{N}CH_2CH_2N(CH_2CH_2COO^-Na^+)_2$$

wherein M is independently selected from the group consisting of hydrogen, sodium, and potassium.

* * * * *